US011678707B1

(12) United States Patent
Englert

(10) Patent No.: US 11,678,707 B1
(45) Date of Patent: Jun. 20, 2023

(54) CAP FOR COVERING EYES

(71) Applicant: Logan Englert, Topeka, KS (US)

(72) Inventor: Logan Englert, Topeka, KS (US)

( * ) Notice: Subject to any disclaimer, the term of this patent is extended or adjusted under 35 U.S.C. 154(b) by 0 days.

(21) Appl. No.: 17/689,566

(22) Filed: Mar. 8, 2022

(51) Int. Cl.
*A42B 1/006* (2021.01)

(52) U.S. Cl.
CPC ..... *A42B 1/006* (2013.01)

(58) Field of Classification Search
CPC ..... A42B 1/004; A42B 1/006; A42B 1/225; A42B 1/0181
See application file for complete search history.

(56) References Cited

U.S. PATENT DOCUMENTS 2,007,235 A * 7/1935 Elberta ..... A42B 1/006 2/209.13
5,275,419 A * 1/1994 Kazemi ..... A63B 63/08 D2/882
D386,888 S * 12/1997 Grant ..... D2/875
5,815,841 A * 10/1998 Spangrud ..... A42B 1/004 2/209.13
5,839,121 A * 11/1998 Morales ..... A42B 3/281 2/DIG. 1
6,647,553 B2 * 11/2003 Hoyez ..... A42C 5/04 2/209.12
7,082,618 B1 * 8/2006 Muso ..... A42B 1/0182 2/175.1
7,240,372 B2 * 7/2007 Larson ..... A42B 1/24 2/173
7,454,799 B2 * 11/2008 Wuensche ..... A42B 1/225 2/172
D594,185 S * 6/2009 Lacy ..... D2/879
D613,040 S * 4/2010 Pearson ..... D2/886
D617,537 S * 6/2010 Pearson ..... D2/884
D654,252 S * 2/2012 Denny ..... D2/887
D691,349 S * 10/2013 Pearson ..... D2/882
D692,213 S * 10/2013 Brack ..... D2/891
D697,288 S * 1/2014 Pearson ..... D2/882
8,763,163 B1 * 7/2014 Johns ..... A42B 1/22 2/200.1
D713,622 S * 9/2014 Steel ..... D2/866
9,215,902 B2 * 12/2015 Johns ..... G02C 3/02
D791,447 S * 7/2017 Thornton ..... A42B 1/22 D2/881
10,194,709 B1 * 2/2019 Jones ..... A42B 1/006
(Continued)

*Primary Examiner* — Sally Haden
(74) *Attorney, Agent, or Firm* — Dale J. Ream

(57) ABSTRACT

A headcover, such as a baseball-style cap, for selectively covering a wearer's eyes, such as to induce sleep, is movable between a use configuration atop the wearer's head and a deployed configuration pulled down and covering a wearer's eyes without nasal obstruction, i.e., avoiding interference of a wearer's nose with the brim of the cap. The cap includes a crown portion and a body section extending rearwardly and downwardly from the crown, the body section including a perimeter edge for selectively receiving the wearer's head. The cap includes a brim extending forwardly from the front section. The brim has a rearward edge coupled to a lower edge of the front of the crown portion, the rearward edge having opposed ends and defining an aperture midway between opposed ends. Further, the lower edge of the front section defines a notch positioned in communication with the aperture associated with the brim.

15 Claims, 4 Drawing Sheets

(56) References Cited

U.S. PATENT DOCUMENTS

| | | | | | |
|---|---|---|---|---|---|
| D849,370 | S * | 5/2019 | Garcia | D2/893 | |
| D871,028 | S * | 12/2019 | Houston | D2/891 | |
| 10,736,369 | B2 * | 8/2020 | Shaw | A42B 7/00 | |
| 2002/0162157 | A1 * | 11/2002 | Hoyez | A42B 1/225 | 2/171 |
| 2004/0128740 | A1 * | 7/2004 | Hoyez | A42C 5/04 | 2/209.7 |
| 2008/0141438 | A1 * | 6/2008 | Reitz | A42B 1/004 | 2/10 |
| 2008/0250547 | A1 * | 10/2008 | Frank | A42B 1/245 | 2/205 |
| 2009/0151047 | A1 * | 6/2009 | Garza | A42B 1/225 | 2/209.13 |
| 2013/0254973 | A1 * | 10/2013 | Baroch | A42B 1/004 | 2/209.13 |
| 2016/0021963 | A1 * | 1/2016 | Johns | A42B 1/004 | 2/209.11 |
| 2016/0219962 | A1 * | 8/2016 | Abers | A42B 1/245 | |
| 2017/0258165 | A1 * | 9/2017 | Thornton | A42B 1/0182 | |
| 2019/0000206 | A1 * | 1/2019 | Domizi | A42B 1/225 | |
| 2019/0174855 | A1 | 6/2019 | D'ambrosio | | |
| 2020/0068975 | A1 * | 3/2020 | Brzoska | A42B 1/0183 | |
| 2022/0047027 | A1 * | 2/2022 | Marquez Diaz | A42B 1/241 | |

* cited by examiner

CAP FOR COVERING EYES

BACKGROUND OF THE INVENTION

This invention relates generally to sleeping aids and, more particularly, to a baseball style cap that is movable from a traditional top of the head configuration to a lowered configuration for napping without nasal obstruction such that the crown completely covers a user's eyes to become a sleep mask.

A so-called "nap" is a short period of sleep that one might take during the daytime, in order to get the necessary amount of rest. Although associated most traditionally with toddlers, around one-third of American adults still take naps daily. The right amount of nap time is around 10-20 minutes, as researchers have proven that it takes at least 30 minutes to enter the slow-wave sleep where one is at their deepest of sleep. If one naps for too long, it can be hard to awake from this nap and leaves the sleeper feeling unrested. Fulfillment naps are naps taken to fulfill one's body. These may be referred to as scheduled naps but can also occur at any time of the day when a person becomes in need of rest.

In some parts of the world, such as in many South-American and some European cultures, the "siesta" habit of taking short naps one or two times a day have been associated with a lower coronary mortality, possibly due to reduced cardiovascular stress mediated by daytime sleep. The idea of taking a short nap during daylight hours raises its own problems, namely, of how to induce sleep while at work in the office, in a vehicle, in the field, or the like. It may not be feasible or desirable to put on a traditional sleep mask, seal out natural light with heavy curtains, or the like. Instead, workers who normally wear a baseball-style cap may simply desire to pull the visor or brim down over his eyes to shut out natural light for a few minutes.

Various proposals and products have been made for modifying a cap to include or be modified into a sleep mask. For instance, the patents propose including a foldout sleep mask from under the visor or from a rear band of the cap. Although presumably effective, the existing proposals do not address the user's simple desire to just pull the visor downwardly over the nose and, therefore, the crown covers the eyes in order to efficiently shut out light for a few minutes. The problem, of course, is the user's nose is in the way and obstructs this downward movement of the visor.

Therefore, it would be desirable to have a baseball style cap that is movable from a traditional top of the head configuration to a lowered configuration such that the crown completely covers a user's eyes to become a sleep mask. Further, it would be desirable to have a baseball style cap in which the visor defines a hole or cutout adjacent the crown such that the visor is not impeded by a user's nose as the visor is pulled downwardly.

SUMMARY OF THE INVENTION

According to the present invention, a headcover, such as a baseball-style cap, for selectively covering a wearer's eyes, such as to induce sleep, is movable between a normal use configuration atop the wearer's head and a deployed configuration pulled down and covering a wearer's eyes without nasal obstruction, i.e., avoiding interference of a wearer's nose with the brim of the cap. The cap includes a crown portion having a generally upstanding front section and a body section extending rearwardly and downwardly from an upper edge of the front section, the body section including a perimeter edge having a circular shape that defines an open bottom and interior area for selectively receiving the wearer's head. the cap includes a brim extending forwardly from a lower edge of the front section. The brim has a rearward edge coupled to the lower edge of the front section, the rearward edge having opposed ends and defining an aperture midway between opposed ends of the rearward edge. Further, the lower edge of the front section defines a notch that is positioned adjacent to and in communication with the aperture associated with the brim.

Therefore, a general object of this invention is to provide a baseball style cap having a visor that defines a cutout adjacent the cap's crown such that the visor is not impeded by a user's nose as the visor is pulled downwardly.

Another object of this invention is to provide a cap, as aforesaid, that enables the cap's crown to be pulled down over a user's eyes while the cap is being worn normally atop the user's head.

Still another object of this invention is to provide a cap, as aforesaid, in which the visor cutout is clandestine, i.e., is not visible when the cap is worn normally.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1B:
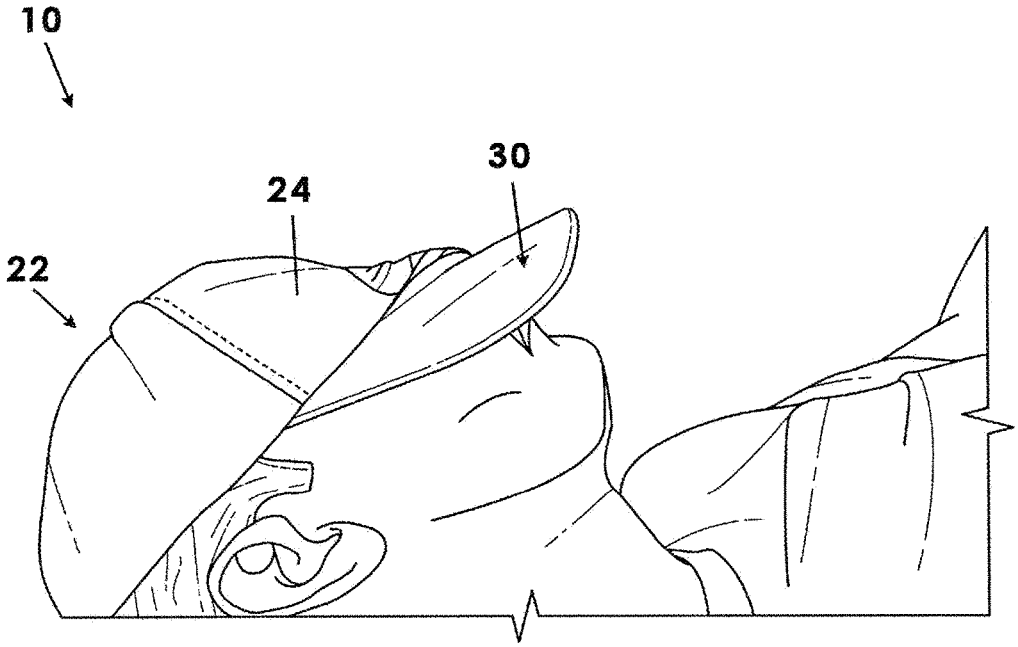
FIG. 1B is another perspective view of the cap as in FIG. 1, illustrated in a lowered configuration blocking light from a user's eyes.
Figure 1A:
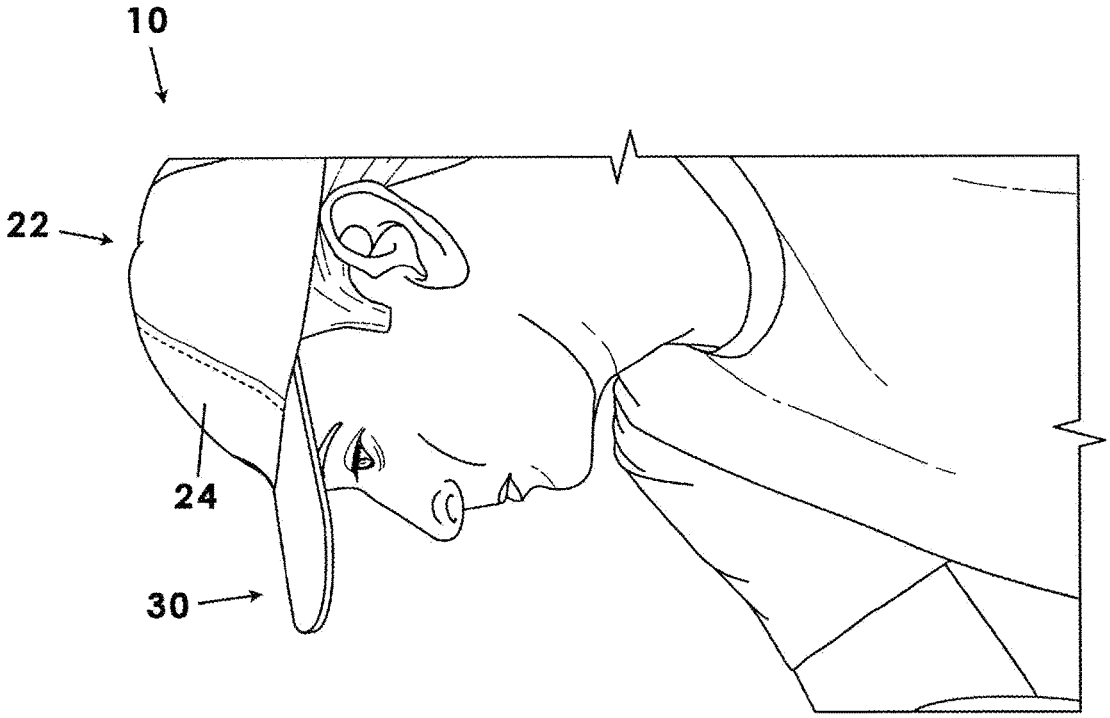
FIG. 1A is a perspective view of a cap for napping according to a preferred embodiment of the present invention, illustrated in a normal use configuration atop a user's head.
Figure 2A:
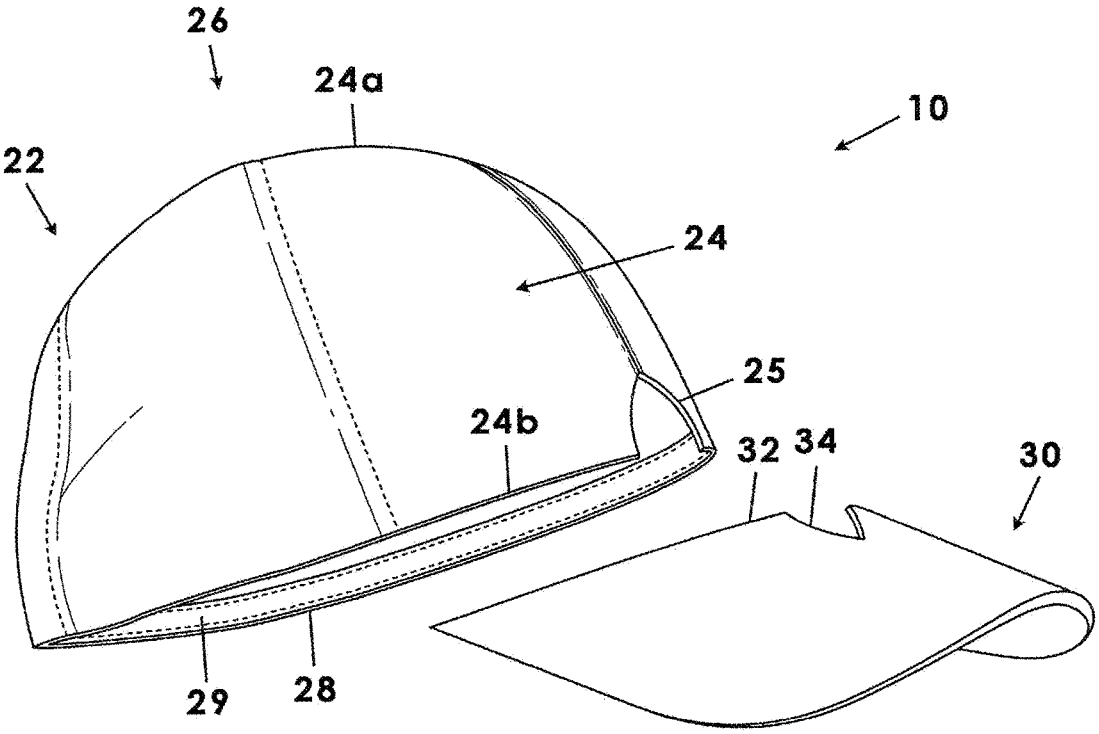
FIG. 2A is a partial exploded view of the cap as in FIG. 1A, illustrated removed from a user's head.
Figure 2B:
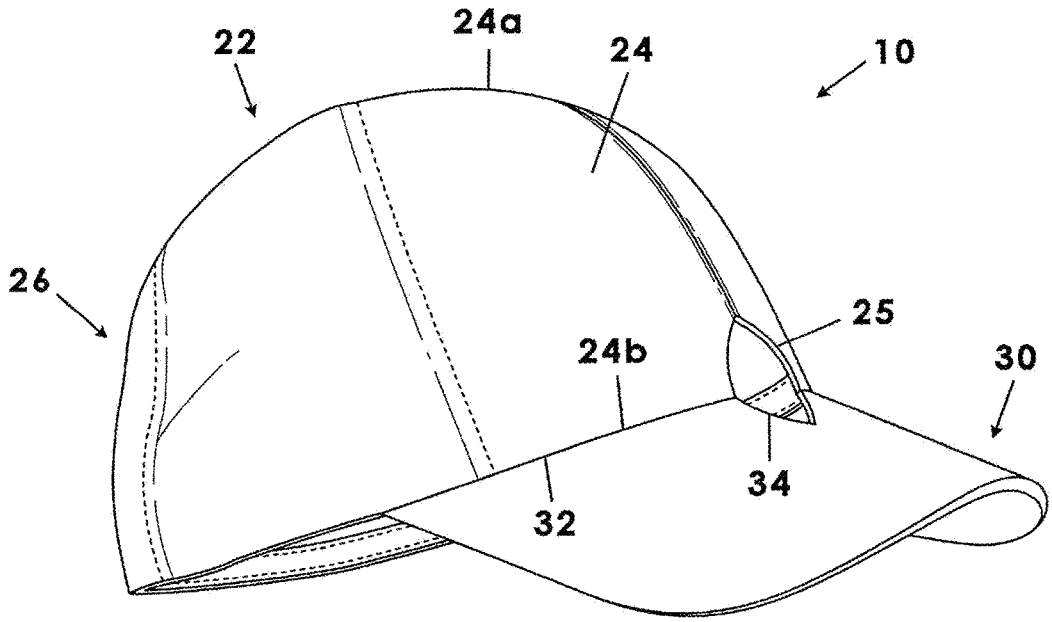
FIG. 2B is an integrated perspective view of the cap as in FIG. 2A.
Figure 3A:
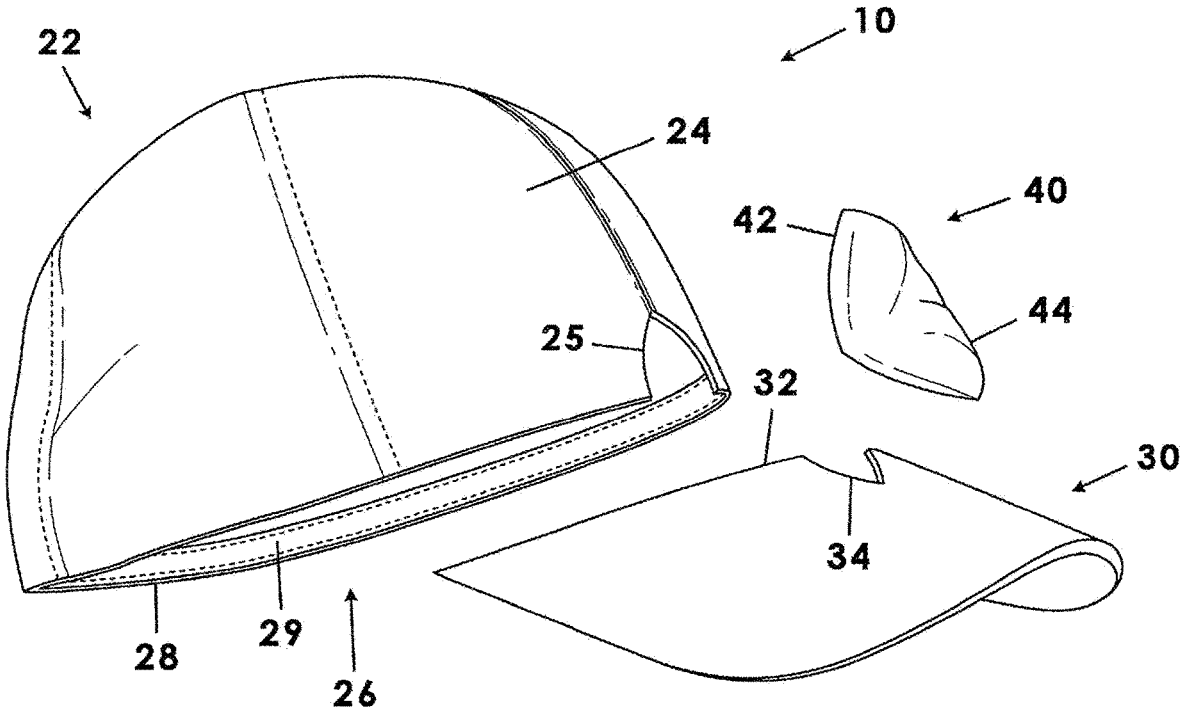
FIG. 3A is a complete exploded view of the cap as in FIG. 1A.
Figure 3B:
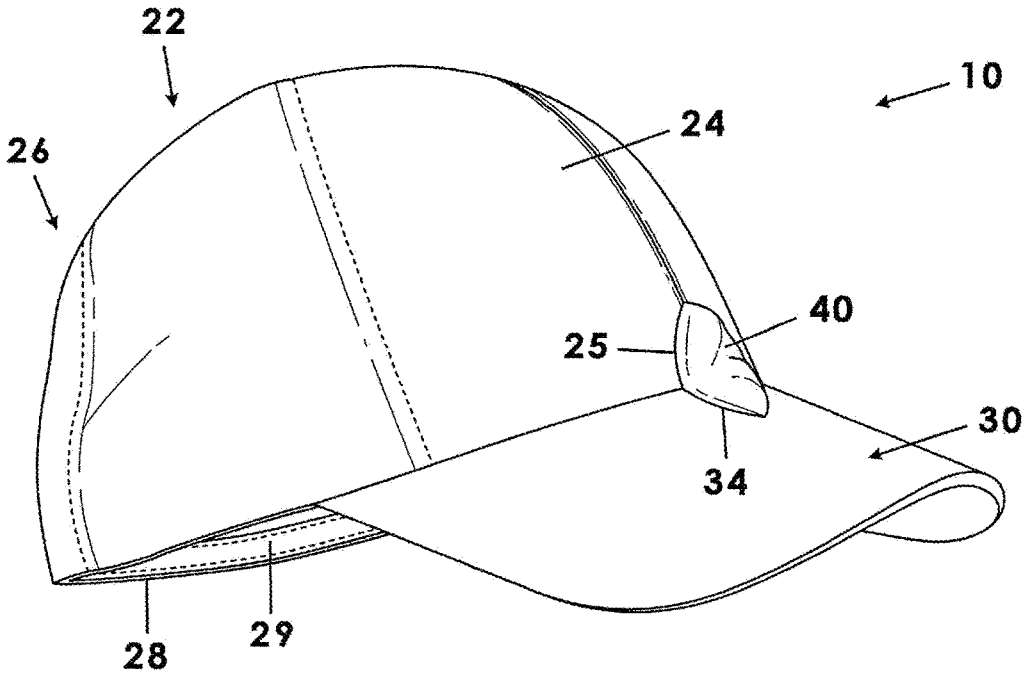
FIG. 3B is an integrated perspective view of the cap as in FIG. 3A.

A cap for napping according to a preferred embodiment of the present invention will now be described with reference to FIG. 1A to 4 of the accompanying drawings.

The headcover 10 of the present invention will also be referred to a baseball-style cap 10 or just a cap 10. The actual structure, construction, and configuration of the baseball-style cap 10 is critical to its functionality and, as a result, will be described and shown in the drawings in significant detail. The baseball-style cap 10 includes what appears to be a traditional crown and brim although critical details are generally unseen and hidden as will be described below in more detail.

Figure 4:
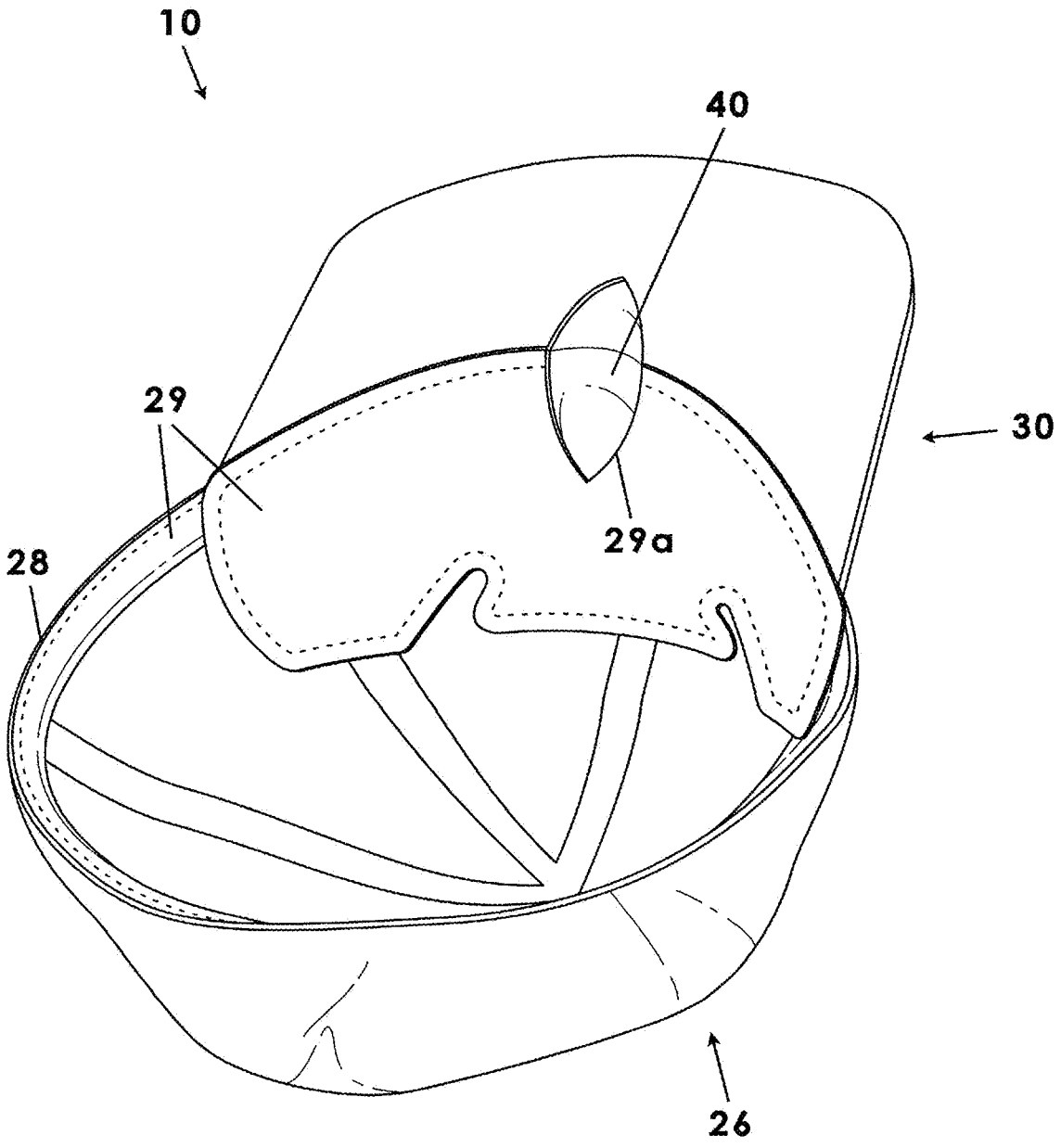
FIG. 4 is a perspective view of from a bottom angle of the cap as in FIG. 3B.

Specifically, the cap 10 includes a crown portion 22 having a generally upstanding front section 24 and a body section 26 that extends rearwardly and downwardly from an upper edge 24*a* of the front section 24, the body section 26 having a generally hemispherical configuration terminating at a perimeter edge 28 having a circular configuration that is complementary to a configuration of a wearer's head. The front section 24 may be an angled panel (rather than vertical) and, in any case, includes an upper edge 24*a* and a lower edge 24*b*. The body section 26 defines an open interior area that is accessible via an open bottom defined by the perimeter edge 28. As a result, the perimeter edge 28 and open area is configured to receive a wearer's head. In any case, the perimeter edge 28 has a circular configuration. In an embodiment, the circumference of the perimeter edge 28 may be adjustable so as to fit comfortably yet tightly atop wearer's having unique head sizes, such as by including an adjustable length strap, clasp, or the like. In an embodiment, a sweatband 29 may be coupled to an interior surface of the body section 26 adjacent the perimeter edge 28, the sweatband 29 being constructed of a material that is absorbent of perspiration that may be expressed by the head of a user while wearing the cap 10. The sweatband 29 may include a thin-width perimeter portion as well as a larger forehead portion adjacent the front section 24—both sections referred to as sweatband 29 (FIG. 4).

Further, the baseball-style cap 10 may include a brim 30 that extends forwardly away from the front section 24 of the crown portion 22. More particularly, the brim 30 includes a rearward edge 32 that is coupled to the lower edge 24*b* of the front section 24. In other words, the rearward edge 32 has a unitary construction with the lower edge 24*b* except as specifically described below. The rearward edge 32 includes opposed ends 32*a*. In a critical aspect, then, the rearward edge 32 defines an aperture 34 centered midway between the opposed ends 32*a*, said aperture 34 being a void inset into the brim 30 and defining a void or break in the rearward edge 32. The aperture 34 is adjacent the lower edge 24*b* of the front section 24. It will be understood that the aperture 34 has a shape configuration that approximates the shape configuration and dimension of a human nose so that the brim 30 may be pulled downwardly across the base of a wearer yet avoiding contact with the wearer's nose. In other words, the aperture 34 is dimensioned so as to receive a wearer's nose therethrough without interference or obstruction. In an embodiment, the aperture 34 may have a generally U-shaped configuration that is inset in the brim 30 and is a void that is unattached to the lower edge 24*b* of the front section 24 of the crown portion 22. In other embodiments, the aperture 34 a have a generally square, rectangular, oval configuration or the like so long as having dimensions suitable for avoiding any obstruction or contact with a wearer's nose.

In another critical aspect, the lower edge 24*b* of the front section 24 may define a notch 25 that is adjacent and in communication with the aperture 34 described above. Preferably, the notch 25 has an inverted V-shaped configuration although an inset having an upwardly semicircular, rounded, or squared off configuration would also work. It will be understood that the aperture 34 and notch 25 may be generally perpendicular to one another in that said brim 30 and said front section 24 are generally perpendicular to one another. In any case, the notch 25 and aperture 34 are connected and in communication with one another so that, together, they defined a nose avoidance opening 36. In other words, when the brim 30 is pulled down from its normal configuration atop a user's head toward the user's upper lip, the user's nose will pass unobstructed through the nose avoidance opening 36, resulting in the front section 24 of the crown portion 22 covering the user's eyes.

Similarly, the sweatband 29 may define a cutout that will be referred to as an auxiliary notch 29*a* adjacent the perimeter edge 28 and adjacent the notch 25 defined by the front section 24 which was described immediately above. Preferably, the auxiliary notch 29*a* has a shape configuration that is identical or substantially similar to a dimension of the notch 25 although a configuration that is at least concentric to a configuration of the notched 25 may also work. Specifically, the auxiliary notch 29*a* is defined by both the forehead and perimeter portions. The purpose of the auxiliary notch 29, of course, is to enable a wearer's nose to be avoided when the brim 30 is pulled downwardly as described above.

In another aspect, all or part of the baseball-style cap 10 may be constructed of cotton. Cotton is a natural fiber that is soft and breathable and often used in manufacturing hats. In fact, embroidered logos and designs may be made of cotton as well. More particularly, when manufacturing caps, cotton may be blended with other materials such as polyester or rayon so as to be more durable. While cotton may be preferred, other materials may be used or incorporated such as wool (for warmth), polyester (for durability), or linen (for softness).

In yet another critical aspect, the headcover 10 includes a panel 40 that is constructed of a flexible fabric material and configured for covering the notch 25 and aperture 34 such that those respective voids are hidden and, therefore, clandestine in their functionality to cover the nose obstruction opening. More particularly, the panel 40 may include a first edge 42 coupled, such as by sewing, to an inner surface of the front section 24 adjacent the lower edge 24*b* thereof (FIG. 4). Further, the panel 40 may include a second edge 44 coupled, such as by sewing, to a bottom surface of the brim 30 forwardly adjacent a forward edge of the aperture 34. Preferably, the panel 40 has a flexible and opaque cloth construction so as to cover in disguise the aperture 34, the notch 25, and the auxiliary notch 29*a*. It is understood, that the panel 40 may be coupled to an outer surface of the front section 24 and a top surface of the brim 30 rather than the inner surface and bottom surface thereof, respectively. In any case, the panel poorly is loosely positioned and flexible so as to cover the openings while still allowing a wearer's nose to push the panel 40 upwardly when the brim 30 is pulled down over the user's face.

In use, the headcover 10 may be worn atop a user's head in a normal fashion and then pulled down over the front of the user's face without any interference of the user's nose such that the crown portion 22 covers the user's eyes so as to induce or support taking a nap. Specifically, the brim 30 and the outstanding front section 24 defines adjacent openings, respectively, that cooperate to allow a user's nose to pass therethrough when the brim 30 is pulled downwardly. And, in a critical aspect, the openings are hidden by a flexible and opaque fabric panel 40 that covers them such that the anti-obstruction those openings are covered and, therefore, unobservable.

It is understood that while certain forms of this invention have been illustrated and described, it is not limited thereto except insofar as such limitations are included in the following claims and allowable functional equivalents thereof.

The invention claimed is:

1. A headcover for selectively covering a wearer's eyes that is adjustable without nasal obstruction, said headcover comprising:

a baseball-style cap that includes a crown portion having a generally upstanding front section and a body section extending rearwardly and downwardly from an upper edge of said front section, said body section having a perimeter edge that defines an open bottom and interior area for selectively receiving the wearer's head, said cap including a brim extending forwardly from a lower edge of the front section;

wherein said brim has a rearward edge coupled to said lower edge of said front section that defines an aperture midway between opposed ends of said rearward edge;

said aperture being a void inset into the brim and defining a break in the rearward edge;

said lower edge of said front section defines a front section notch that is connected to and in communication with said aperture associated with said brim;

wherein said notch is upstanding and upwardly inset in said front section of the crown portion, said notch and said aperture, together, defining a single nose avoidance opening.

2. The headcover as in claim 1, wherein said aperture has a configuration capable of receiving a human nose.

3. The headcover as in claim 1, wherein said aperture has a shape configuration indicative of a shape of a human nose.

4. The headcover as in claim 1, wherein said aperture having a generally U-shaped configuration that is unattached to said lower edge of said front section of said crown portion.

5. The headcover as in claim 1, further comprising a panel coupled to an inner surface of said front section adjacent said lower edge, said panel having a flexible and opaque construction position for covering said nose avoidance opening.

6. The headcover as in claim 1, wherein said notch has an inverted V shaped configuration.

7. The headcover as in claim 1, wherein said body section of said crown portion includes a sweatband extending circumferentially along an interior surface of said perimeter edge, said sweatband defining an auxiliary notch having a configuration that is identical or concentric to said front section notch.

8. The headcover as in claim 7, further comprising a panel having a first edge coupled to an inner surface of said front section adjacent said lower edge thereof and a second edge coupled to a bottom surface of said brim adjacent a forward edge of said aperture, said panel having a flexible and opaque cloth construction so as to disguise said aperture, said front section notch, and said auxiliary notch.

9. A headcover for selectively covering a wearer's eyes that is movable between a normal use configuration atop the wearer's head and a deployed configuration pulled down and covering a wearer's eyes without nasal obstruction, said headcover comprising:

a baseball-style cap that includes a crown portion having a generally upstanding front section and a body section extending rearwardly and downwardly from an upper edge of said front section, said body section that includes a perimeter edge having a circular shape that defines an open bottom and interior area for selectively receiving the wearer's head, said cap including a brim extending forwardly from a lower edge of the front section;

wherein said brim has a rearward edge coupled to said lower edge of said front section, said rearward edge having opposed ends and defining an aperture midway between opposed ends of said rearward edge;

said aperture being a void inset into the brim and defining a break in the rearward edge;

wherein said aperture has a configuration for interfacing with a human nose;

wherein said lower edge of said front section defines a notch that is connected to and in communication with said aperture associated with said brim;

wherein said notch is upstanding and upwardly inset in said front section of the crown portion, said notch and said aperture, together, defining a single nose avoidance opening.

10. The headcover as in claim 9, wherein said aperture has a shape configuration indicative of a shape of a human nose.

11. The headcover as in claim 9, wherein said aperture has a generally U-shaped configuration that is inset in said brim and unattached to said lower edge of said front section of said crown portion.

12. The headcover as in claim 9, wherein said notch has an inverted V-shaped configuration.

13. The headcover as in claim 9, wherein said body section of said crown portion includes a sweatband extending circumferentially along an interior surface of said perimeter edge, said sweatband defining an auxiliary notch having a configuration that is identical or concentric to said notch.

14. The headcover as in claim 13, further comprising a panel having a first edge coupled to an inner surface of said front section adjacent said lower edge thereof and a second edge coupled to a bottom surface of said brim adjacent a forward edge of said aperture, said panel having a flexible and opaque cloth construction so as to disguise and cover said aperture, said notch, and said auxiliary notch.

15. A headcover for selectively covering a wearer's eyes that is movable between a normal use configuration atop the wearer's head and a deployed configuration pulled down and covering a wearer's eyes without nasal obstruction, said headcover consisting of:

a baseball-style cap that includes a crown portion having a generally upstanding front section and a body section extending rearwardly and downwardly from an upper edge of said front section, said body section that includes a perimeter edge having a circular shape that defines an open bottom and interior area for selectively receiving the wearer's head, said cap including a brim extending forwardly from a lower edge of the front section;

wherein said brim has a rearward edge coupled to said lower edge of said front section, said rearward edge having opposed ends and defining an aperture midway between opposed ends of said rearward edge;

said aperture being a void inset into the brim and defining a break in the rearward edge;

wherein said aperture has a configuration for interfacing with a human nose;

wherein said lower edge of said front section defines a notch that is connected to and in communication with said aperture associated with said brim;

wherein said notch is upstanding and upwardly inset in said front section of the crown portion, said notch and said aperture, together, defining a single nose avoidance opening.

* * * * *